US008256570B2

(12) United States Patent
Miike et al.

(10) Patent No.: US 8,256,570 B2
(45) Date of Patent: Sep. 4, 2012

(54) EXHAUST FLOW CONTROL DEVICE FOR EXHAUST MUFFLER

(75) Inventors: Koji Miike, Hamamatsu (JP); Kazuhiro Tsuda, Hamamatsu (JP); Katsunori Okoshi, Hamamatsu (JP); Takatoshi Goto, Hamamatsu (JP)

(73) Assignee: Yutaka Giken Co., Ltd., Shizuoka (JP)

( * ) Notice: Subject to any disclaimer, the term of this patent is extended or adjusted under 35 U.S.C. 154(b) by 0 days.

(21) Appl. No.: 13/045,181

(22) Filed: Mar. 10, 2011

(65) Prior Publication Data

US 2012/0055734 A1 Mar. 8, 2012

(30) Foreign Application Priority Data

Sep. 6, 2010 (JP) ..... 2010-198649

(51) Int. Cl.
*F01N 1/08* (2006.01)

(52) U.S. Cl. ..... 181/254

(58) Field of Classification Search ..... 181/226, 181/237, 253, 254
See application file for complete search history.

(56) References Cited

U.S. PATENT DOCUMENTS

| | | | | |
|---|---|---|---|---|
| 5,452,578 | A * | 9/1995 | Barber | 60/324 |
| 5,603,214 | A * | 2/1997 | Abels et al. | 60/273 |
| 6,065,564 | A * | 5/2000 | Uegane | 181/237 |
| 6,189,650 | B1 * | 2/2001 | Inuzuka et al. | 181/254 |
| 6,499,562 | B1 * | 12/2002 | Elfinger et al. | 181/251 |
| 7,066,296 | B2 * | 6/2006 | Uegane et al. | 181/254 |
| 7,310,942 | B2 * | 12/2007 | Shiga et al. | 60/324 |
| 7,451,854 | B2 * | 11/2008 | Suzuki et al. | 181/237 |
| 2010/0126159 | A1 * | 5/2010 | Han et al. | 60/324 |

FOREIGN PATENT DOCUMENTS

| | | | |
|---|---|---|---|
| JP | 02081911 | A * | 3/1990 |
| JP | 2000-002112 | A | 1/2000 |

* cited by examiner

*Primary Examiner* — Jeremy Luks
(74) *Attorney, Agent, or Firm* — Arent Fox LLP

(57) ABSTRACT

An exhaust flow control valve includes: a valve plate hinged to a downstream exhaust pipe to be pivotable, inside the pipe, between a fully closed position where a short-cut hole is closed and a fully open position where the short-cut hole is opened, the valve plate having a tip end directed toward a downstream side of the downstream exhaust pipe when at the fully open position; a spring receiving member provided to the downstream exhaust pipe to traverse the short-cut hole; and a valve spring having one end portion fastened to a tip end portion, which is located on the downstream side of the downstream exhaust pipe with respect to the spring receiving member, of the valve plate, and having an opposite end side being slidably in pressure contact with the spring receiving member, thereby generating a repulsive force to bias the valve plate toward the fully closed position.

6 Claims, 13 Drawing Sheets

EXHAUST FLOW CONTROL DEVICE FOR EXHAUST MUFFLER

BACKGROUND OF THE INVENTION

1. Field of the Invention

The present invention relates to an improvement of an exhaust flow control, device for an exhaust muffler, comprising: a short-cut hole provided in an intermediate portion in a longitudinal direction of a downstream exhaust pipe connected to a muffler body, the downstream exhaust pipe having one end portion communicating with an inside of the muffler body and having an opposite end portion opened to atmospheric air, the short-cut hole allowing communication between the inside of the muffler body and an inside of the intermediate portion of the downstream exhaust pipe; and an exhaust flow control valve appended to the downstream exhaust pipe and configured to close the short-cut hole when a pressure in the muffler body is lower than a predetermined value, and open the short-cut hole when the pressure is at the predetermined value or higher.

2. Description of the Related Art

Such an exhaust flow control device for an exhaust muffler is already known, as disclosed in Japanese Patent Application Laid-open No. 2000-2112.

According to such an exhaust flow control device for an exhaust muffler, during low-speed, low-load operation of the engine, exhaust gas from the engine is caused to flow throughout the downstream exhaust pipe by closing the exhaust flow control valve. Hence, reduction in the low-frequency noise can be achieved. Meanwhile, during high-speed, high-load operation of the engine, the exhaust flow control valve is opened as the pressure in the muffler body increases. Thus, exhaust gas from the engine flows only for a short distance from the short-cut hole in the middle portion of the downstream exhaust pipe to the downstream end thereof. Hence, the back pressure is reduced, and both improvement in the engine output and reduction in the gas flow sound can be achieved.

However, in such a conventional exhaust flow control device for an exhaust muffler, as disclosed in Japanese Patent Application Laid-open No. 2000-2112, a valve spring for biasing a valve plate in a closing direction is formed of a coil spring whose fixed end is connected to the downstream exhaust pipe, and whose free end is connected to the valve plate. For this reason, as represented by a line L in FIG. 13, the torque of the valve spring for closing the valve plate increases as the opening degree of the valve plate increases. Thus, it becomes difficult to wide-open the valve plate, making it difficult to sufficiently obtain the above-described characteristics during high-speed, high-load operation of an engine.

SUMMARY OF THE INVENTION

The present invention has been made in view of such circumstances. An object thereof is to provide an exhaust flow control device for an exhaust muffler, in which the valve-closing force of a valve spring for a valve plate decreases, or hardly changes, as the opening degree of the valve plate increases, thereby readily enabling wide opening of an exhaust flow control valve by an increase in the pressure in a muffler body during high speed, high-load operation of an engine, and achieving the characteristics of reduction in the back pressure and reduction in the gas flow sound.

In order to achieve the object, according to a first feature of the present invention, there is provided an exhaust flow control device for an exhaust muffler, comprising: a short-cut hole provided in an intermediate portion in a longitudinal direction of a downstream exhaust pipe connected to a muffler body, the downstream exhaust pipe having one end portion communicating with an inside of the muffler body and having an opposite end portion opened to atmospheric air, the short-cut hole allowing communication between the inside of the muffler body and an inside of the intermediate portion of the downstream exhaust pipe; and an exhaust flow control valve appended to the downstream exhaust pipe and configured to close the short-cut hole when a pressure in the muffler body is lower than a predetermined value, and open the short-cut hole when the pressure is at the predetermined value or higher, wherein the exhaust flow control valve comprises: a valve plate hinged to the downstream exhaust pipe in such a manner as to be pivotable, inside the downstream exhaust pipe, between a fully closed position where the short-cut hole is closed and a fully open position where the short-cut hole is opened, the valve plate having a tip end directed toward a downstream side of the downstream exhaust pipe when at the fully open position; a spring receiving member provided to the downstream exhaust pipe in such a manner as to traverse the short-cut hole; and a valve spring having one end portion fastened to a tip end portion of the valve plate, the tip end portion being located on the downstream side of the downstream exhaust pipe with respect to the spring receiving member, and having an opposite end side being in pressure contact with the spring receiving member in a slidable manner, thereby generating a repulsive force to bias the valve plate toward the fully closed position.

According to the first feature of the present invention, it is possible to cause the torque for closing the valve plate by the valve spring to decrease or hardly change as the opening degree of the valve body increases. Thereby, the valve-opening response of the valve body is improved, and reduction in the back pressure and reduction in the gas flow sound can be surely achieved in the exhaust muffler during high-speed, high-load operation of the engine.

According to a second feature of the present invention, in addition to the first feature, a base end portion of the valve plate is connected to an inner wall of the downstream exhaust pipe through a flexible hinge member.

According to the second feature of the present invention, the employment of the flexible hinge member makes smooth the opening and closing operations of the valve plate, and the loss in the spring force of the valve spring can be reduced.

According to a third feature of the present invention, in addition to the first feature, a hook-shaped hinge portion is formed at a base end portion of the valve plate, and the hinge portion pivotably engages with a hinge hole of a support member that is fastened to an inner wall of the downstream exhaust pipe.

According to the third feature of the present invention, the hinge connection structure of the valve plate to the downstream exhaust pipe can be obtained at low costs.

According to a fourth feature of the present invention, in addition to the first feature, opposite end portions of the rod-shaped spring receiving member are fastened to an outer surface of the downstream exhaust pipe, and the valve spring is in pressure contact with an outer peripheral surface of the spring receiving member in a slidable manner, the outer peripheral surface being raised higher than the outer surface of the downstream exhaust pipe.

According to the fourth feature of the present invention, the rod-shaped spring receiving member can be put into such a state that the outer peripheral surface thereof is raised higher than the outer surface of the downstream exhaust pipe simply by fastening the spring receiving member to the outer surface of the downstream exhaust pipe. Hence, when the valve spring having one end fastened to the tip end portion of the valve plate is brought into pressure contact with the outer peripheral surface of the spring receiving member, the valve spring is warped to thus generate a repulsive force.

According to a fifth feature of the present invention, in addition to the first feature, the spring receiving member is formed as a partition wall that results from punching of the short-cut hole and remains on the downstream exhaust pipe so as to partition the short-cut hole into two, the partition wall has a raised portion formed therein which is raised higher than an outer surface of the downstream exhaust pipe, and the valve spring is in pressure contact with the raised portion in a slidable manner.

According to the fifth feature of the present invention, it is not necessary to use a dedicated member as the spring receiving member. This can contribute to the simplification of the structure, consequently to cost reduction.

According to a sixth feature of the present invention, in addition to any one of the first, fourth and fifth features, the tip end portion, located on a base end portion side of the valve plate with respect to the spring receiving member, of the valve spring is formed into a curved portion curved toward the short-cut hole when the valve plate is at the fully closed position.

According to the sixth feature of the present invention, as the valve plate approaches the fully open position, the curved portion of the valve spring comes into pressure contact with the spring receiving surface, and thereby the valve-closing force of the valve spring for the valve plate can be made substantially constant. This makes it possible to improve the returnability of the valve body to the fully closed position.

The above and other objects, characteristics and advantages of the present invention will be clear from detailed descriptions of the preferred embodiments which will be provided below while referring to the attached drawings.

DESCRIPTION OF THE PREFERRED EMBODIMENTS

Embodiments of the present invention will be described below base on the attached drawings.

First, a first embodiment of the present invention shown in FIGS. 1 to 5 will be described below.

Figure 1:
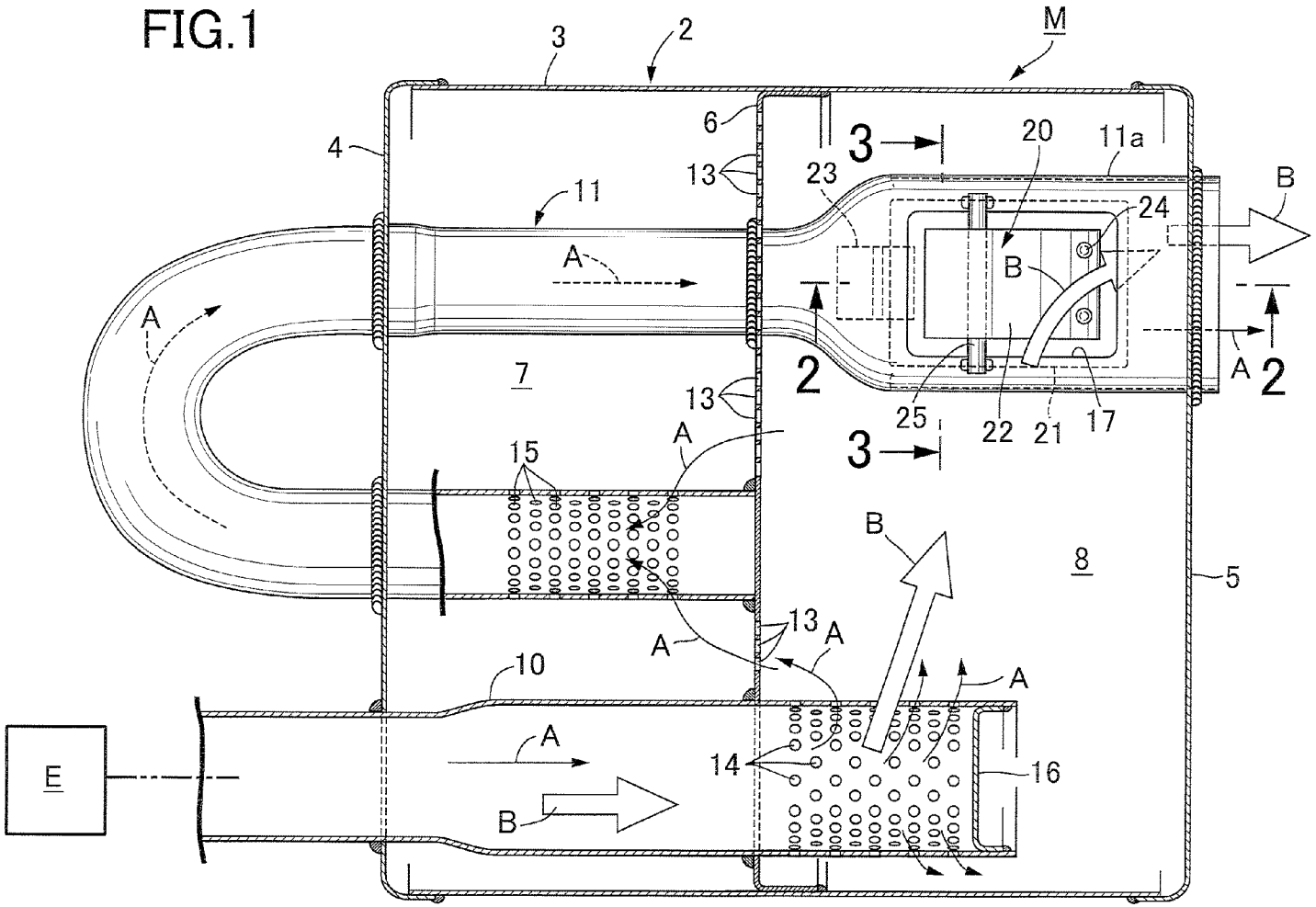
FIG. 1 is a longitudinal cross-sectional view of an exhaust muffler for an engine, according to a first embodiment of the present invention.

In FIG. 1, an exhaust muffler 1 for an automobile includes a muffler body 2, an upstream exhaust pipe 10, and a downstream exhaust pipe 11. The muffler body 2 is formed into a sealed drum shape by a trunk part 3, a front-side end plate 4, and a rear-side end plate 5 which are respectively welded to front and rear ends of the trunk part 3. The inside of the muffler body 2 is partitioned into a front-side silencing chamber 7 and a rear-side silencing chamber 8 by a partition wall plate 6 that is welded to an inner peripheral surface at an intermediate portion of the trunk part 3. The partition wall plate 6 has multiple first silencing holes 13 provided therein to allow communication between the two silencing chambers 7, 8.

The upstream exhaust pipe 10 has an upstream end connected to an exhaust port of an engine E, and penetrates the front-side end plate 4 and the partition wall plate 6, so that a downstream end portion thereof enters the rear-side silencing chamber 8. The downstream end of the upstream exhaust pipe 10 is closed by a welded end plate 16. A peripheral wall of the upstream exhaust pipe 10 within the rear-side silencing chamber 8 has multiple second silencing holes 14 provided therein to allow communication between the inside of the pipe and the rear-side silencing chamber 8. The upstream exhaust pipe 10 is joined to each of the front-side end plate 4 and the partition wall plate 6 by welding.

The downstream exhaust pipe 11 has an upstream end starting from the front-side silencing chamber 7, and has a downstream end opened to atmospheric air. Specifically, the downstream exhaust pipe 11 is formed into a U shape in such a way to penetrate the front-side end plate 4 at one location, bend outside the front-side silencing chamber 7, penetrate the front-side end plate 4 at another location, and further penetrate the front-side silencing chamber 7, the partition wall plate 6, the rear-side silencing chamber 8 and the rear-side end plate 5. The upstream end of the downstream exhaust pipe 11 is closed by a non-perforated portion of the partition wall plate 6. A peripheral wall on the upstream side thereof has multiple third silencing holes 15 provided therein to allow communication between the inside of the pipe and the front-side silencing chamber 7. The downstream exhaust pipe 11 is joined to each of the front-side end plate 4, the partition wall plate 6, and the rear-side end plate 5 by welding.

Figure 2:
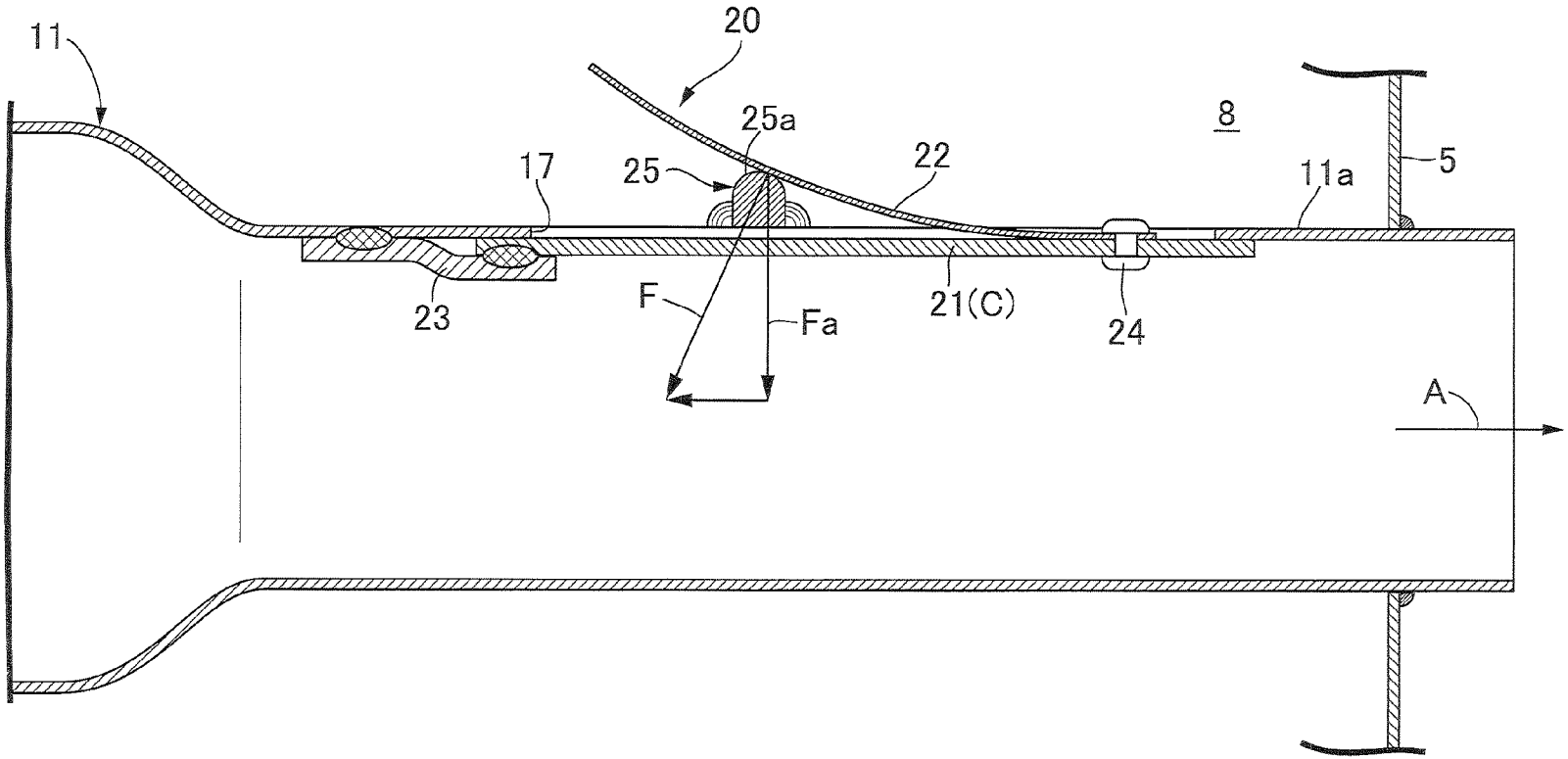
FIG. 2 is an enlarged sectional view taken along a line 2-2 in FIG. 1 (showing a state in which an exhaust flow control valve is fully closed)

As shown in FIGS. 1 and 2, a portion of the downstream exhaust pipe 11 from an intermediate portion within the rear-side silencing chamber 8 to the downstream end is formed as a flattened pipe portion 11*a*. In one flat portion of the flattened pipe portion 11*a*, a short-cut hole 17 is provided, and thereby the inside of the downstream exhaust pipe 11 is opened to the rear-side silencing chamber 8. An exhaust flow control valve 20 is appended to the flattened pipe portion 11*a* so as to open and close the short-cut hole 17.

Figure 3:
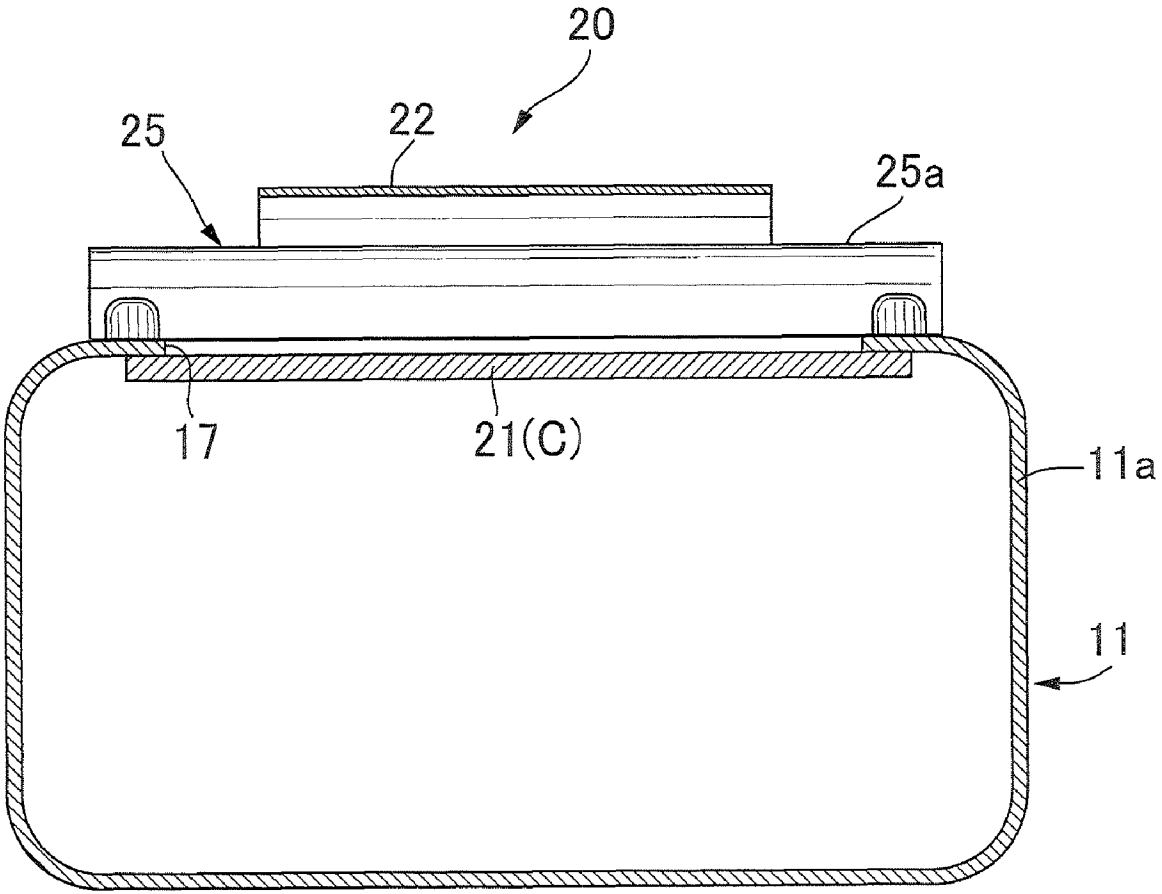
FIG. 3 is an enlarged sectional view taken along a line 3-3 in FIG. 1.

As shown in FIGS. 1 to 3, the exhaust flow control valve 20 mainly includes a plate-shaped valve plate 21, a spring receiving member 25, and a valve spring 22 that is a flat leaf spring.

The valve plate 21 is located inside the flattened pipe portion 11*a*. The valve plate 21 has a free end directed toward the downstream side of the downstream exhaust pipe 11, and has a base end portion pivotably connected to the inner surface of the flat portion of the flattened pipe portion 11*a* through a metallic, net-shaped flexible hinge member 23. Thus, the valve plate 21 pivots between a fully closed position C (FIG. 3) where the short-cut hole 17 is closed and a fully open position O (FIG. 5) where the short-cut hole 17 is opened. At the fully closed position C of the valve plate 21, the valve plate 21 is closely attached to an inner surface, on the short-cut hole 17 side, of the flattened pipe portion 11*a*. At the fully open position O of the valve plate 21, the free end of the valve plate 21 is in contact with an inner surface, on a side opposite to the short-cut hole 17, of the flattened pipe portion 11*a*.

The spring receiving member 25 is rod shaped, and disposed in such a manner that the spring receiving member 25 traverses the short-cut hole 17 perpendicularly to a longitudinal direction of the flattened pipe portion 11*a*. Opposite end portions of the spring receiving member 25 are respectively fixed to outer side surfaces of the flattened pipe portion 11*a* by welding. The spring receiving member 25 has a cylindrical spring receiving surface 25*a* that is raised higher than the outer surface of the flat portion of the flattened pipe portion 11*a*.

The valve spring 22 has one end portion fastened, by a rivet 24, to the tip end portion, which is located on the downstream side of the downstream exhaust pipe 11 with respect to the spring receiving member 25, of the valve plate 21. An opposite end side of the valve spring 22 is in pressure contact with the spring receiving surface 25*a* of the spring receiving member 25, and a repulsive force exerted therefrom biases the valve plate 21 toward the fully closed position C.

Next, operations in this embodiment will be described.

In a low-speed, low-load operation state of the engine E, exhaust gas from the engine E sequentially passes, as indicated by arrows A, through the upstream exhaust pipe 10, the second silencing holes 14, the rear-side silencing chamber 8, the first silencing holes 13, the front-side silencing chamber 7, the third silencing holes 15, and the downstream exhaust pipe 11, while the exhaust noise is being reduced. Thus, the exhaust gas is emitted to atmospheric air. In this event, the pressure in the rear-side silencing chamber 8, which is exerted on the valve plate 21 of the exhaust flow control valve 20, is relatively low. Accordingly, the biasing force of the valve spring 22 keeps the valve plate 21 at the fully closed position C. Thus, the short-cut hole 17 is closed, and the exhaust gas passes throughout the downstream exhaust pipe 11 that is relatively long. Hence, reduction in the low-frequency noise can be achieved.

When the engine E is shifted to a high-speed, high-load operation state, the flow amount of exhaust gas passing through the above route is increased, and the pressure in the rear-side silencing chamber 8 is increased. When the torque of the pressure for opening the valve plate 21 exceeds the torque of the biasing force of the valve spring 22 for closing the valve plate 21, the valve plate 21 pivots toward the fully open position O, increasing the opening degree of the short-cut hole 17. Thereby, the exhaust gas emitted into the rear-side silencing chamber 8 from the upstream exhaust pipe 10 takes a short cut to the short-cut hole 17 as indicated by arrows B according to the opening degree of the short-cut hole 17. Then, guided along the valve plate 21 thus inclined, the exhaust gas passes through a short distance of the downstream exhaust pipe 11 from the short-cut hole 17, and emitted to atmospheric air. Hence, both improvement in the engine output due to reduction in the back pressure and reduction in the gas flow sound can be achieved.

Now, the valve-closing force exerted by the valve spring 22 to the valve plate 21 will be discussed.

As shown in FIG. 2, when the valve plate 21 is kept at the fully closed position C, the valve spring 22 is in pressure contact with the spring receiving surface 25*a* in a posture warped toward a side opposite to the spring receiving member 25, exerting a repulsive force F perpendicularly to the spring receiving surface 25*a*. A component force Fa, which is perpendicular to the outer surface of the flattened pipe portion 11*a*, of the repulsive force F is a valve-closing force Fa biasing the valve plate 21 toward the fully closed position C.

Figure 4:
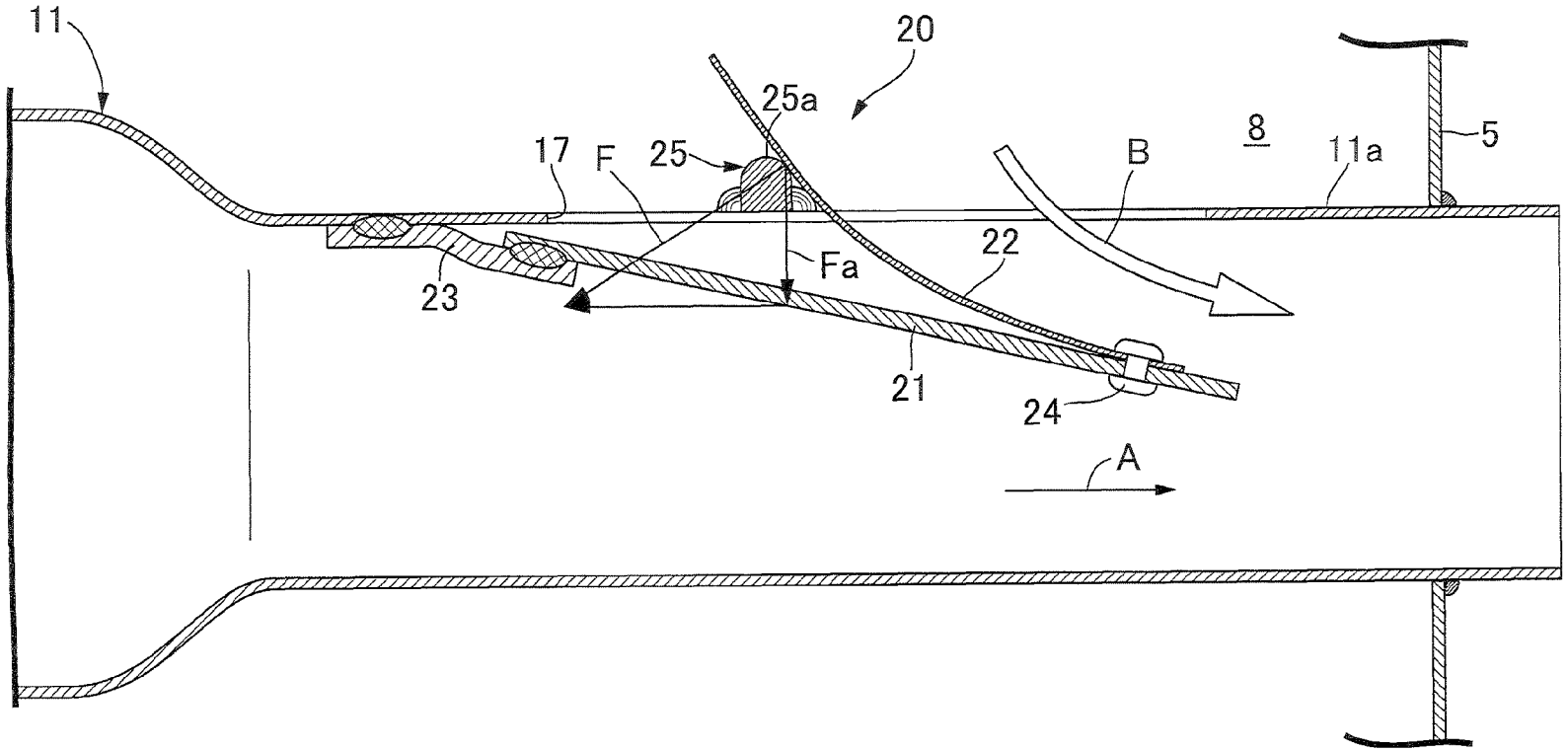
FIG. 4 is a view corresponding to FIG. 2 and showing a state in which the exhaust flow control valve is intermediately-opened.
Figure 5:
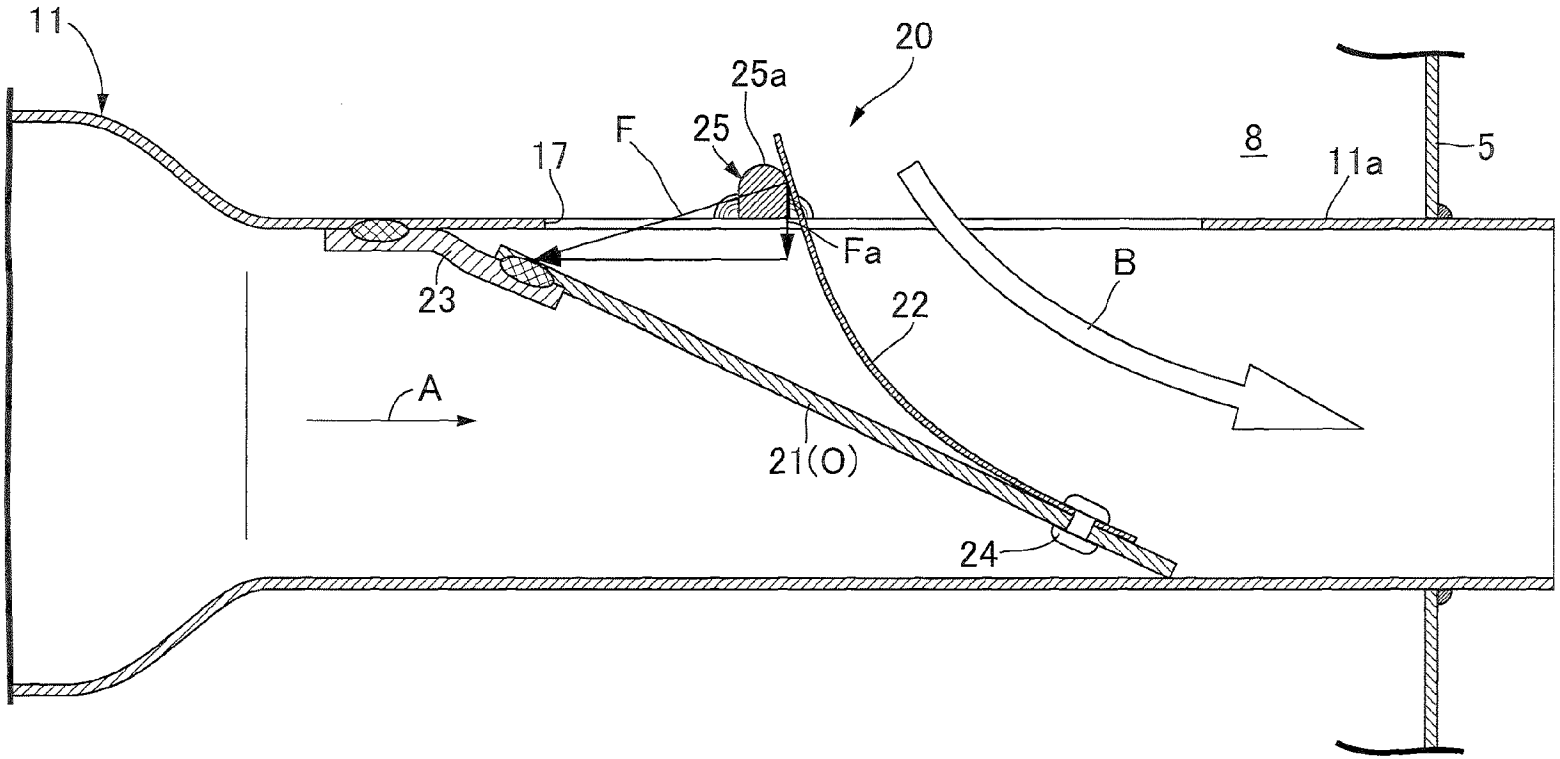
FIG. 5 is a view corresponding to FIG. 2 and showing a state in which the exhaust flow control valve is fully opened.
Figure 6:
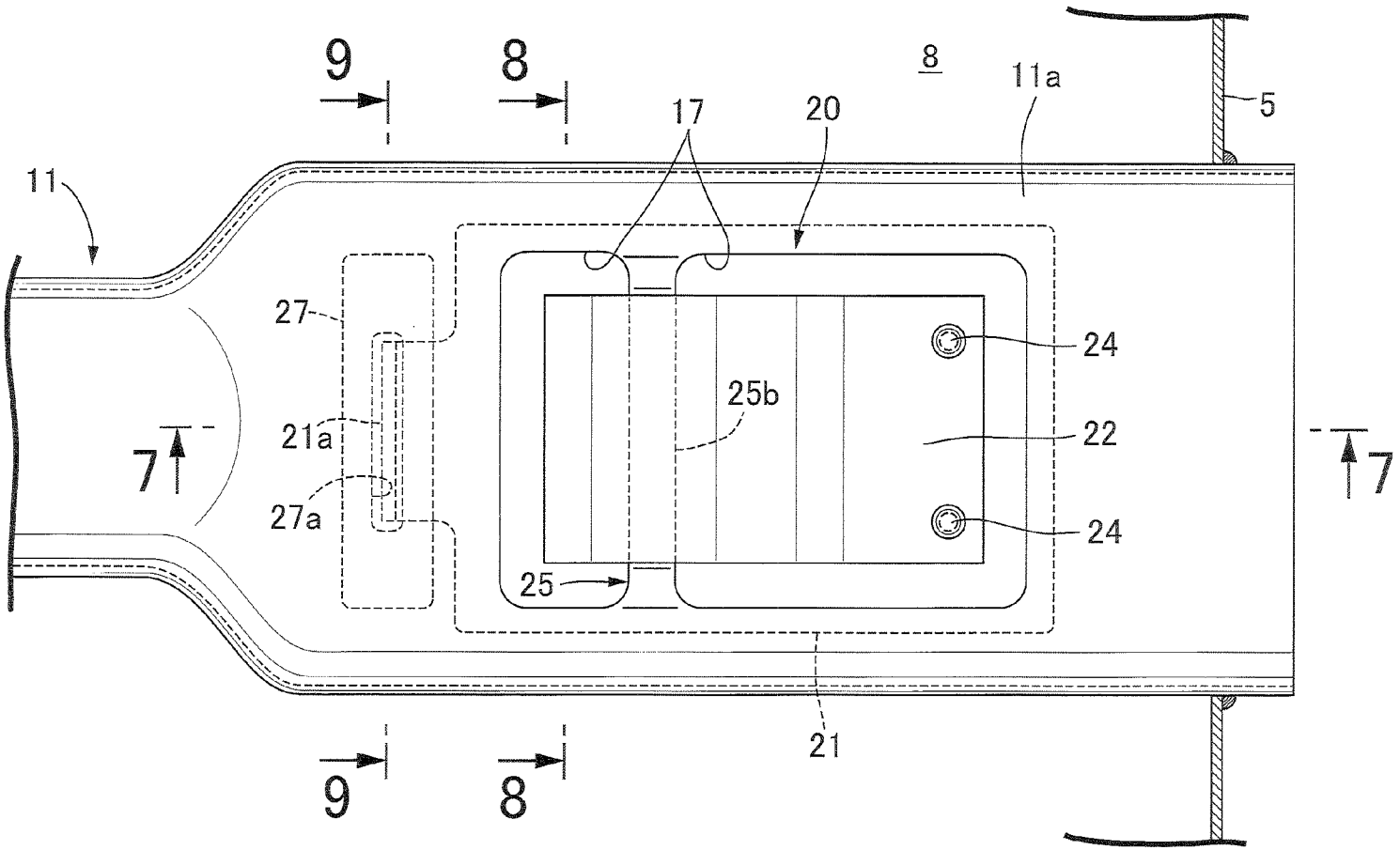
FIG. 6 is a plan view of the exhaust flow control valve and showing a second embodiment of the present invention.
Figure 7:
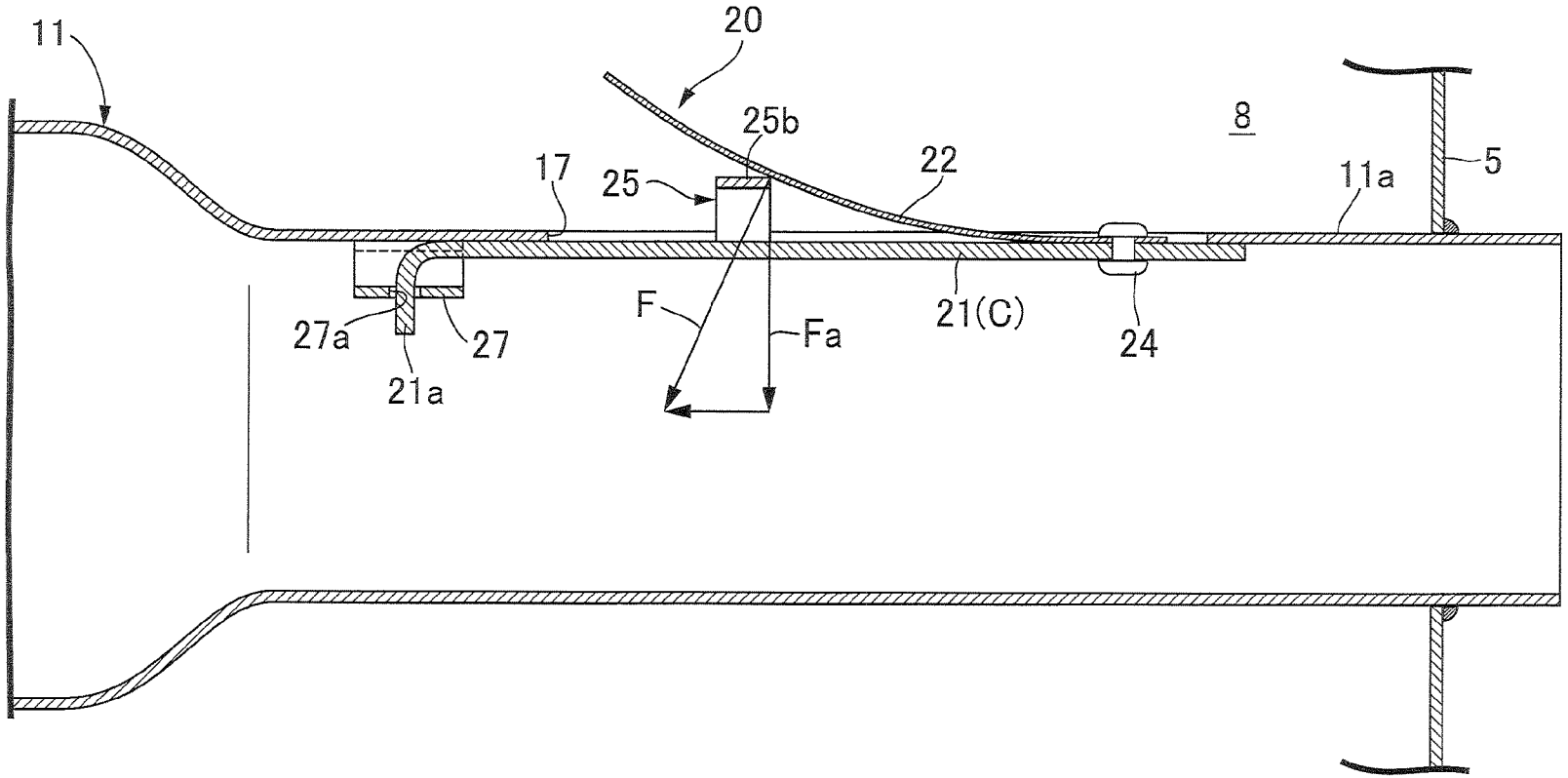
FIG. 7 is a sectional view taken along a line 7-7 in FIG. 6.
Figure 8:
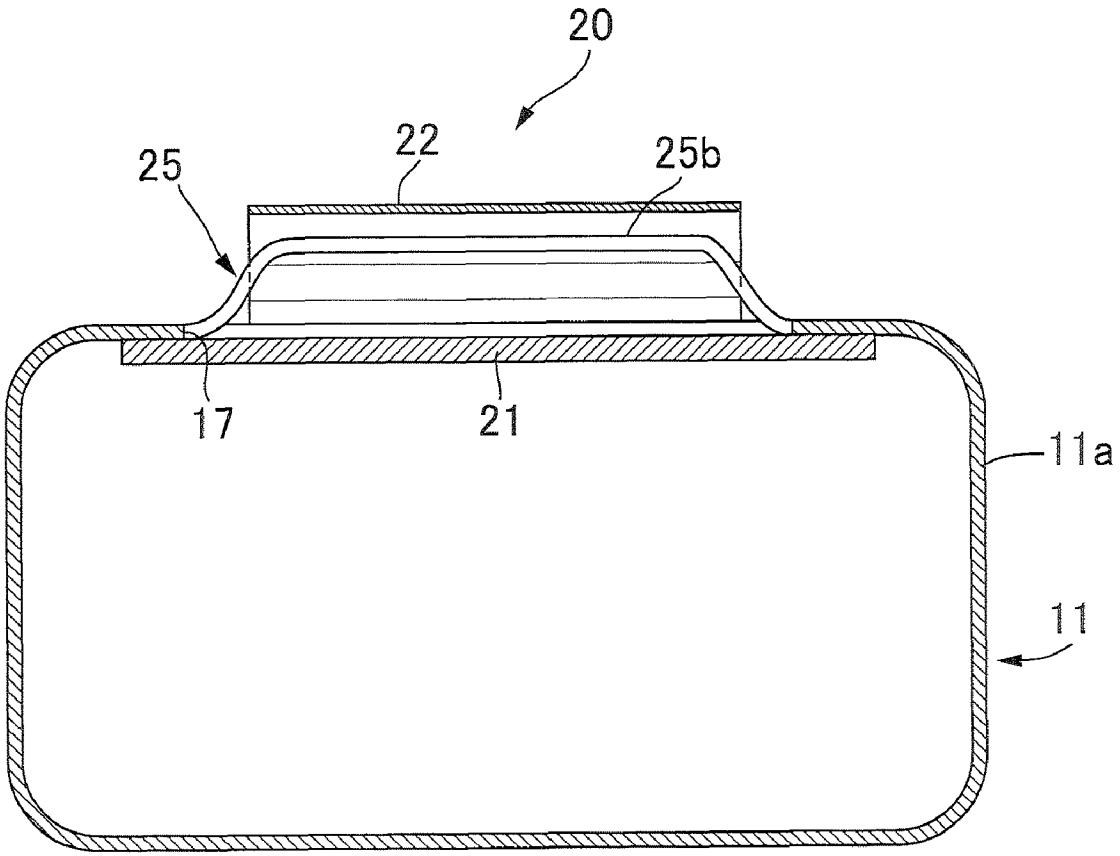
FIG. 8 is a sectional view taken along a line 8-8 in FIG. 6.
Figure 9:
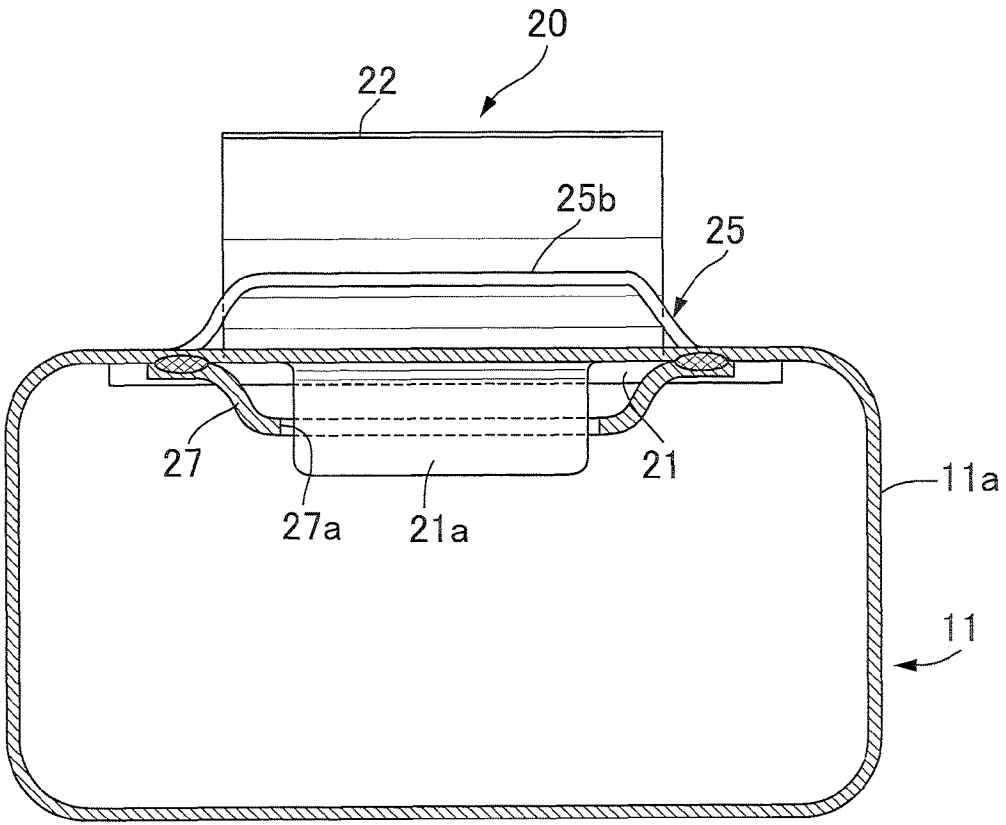
FIG. 9 is a sectional view taken along a line 9-9 in FIG. 6.
Figure 13:
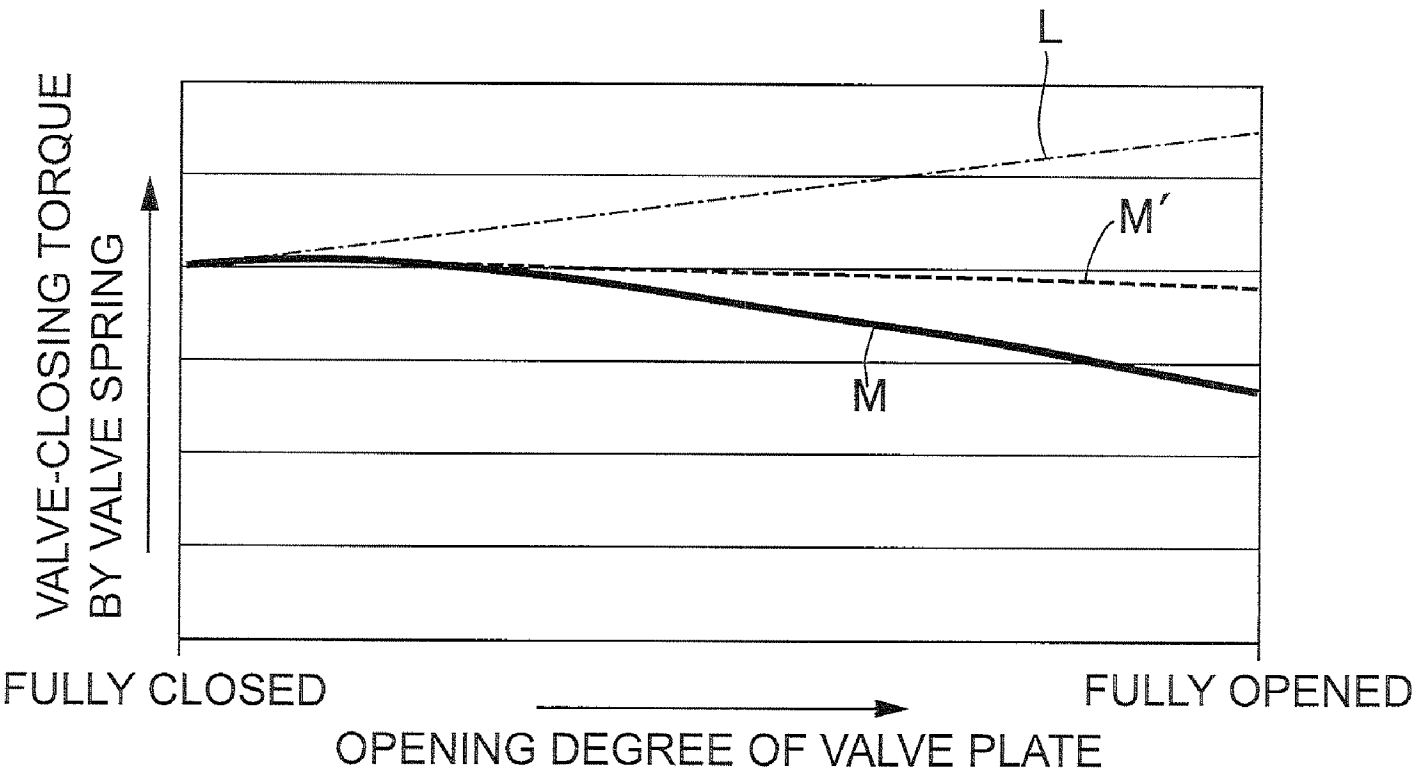
FIG. 13 is a chart showing characteristics of valve-closing torque of exhaust flow control devices: a line L indicates a characteristic of a conventional one, a line M indicates a characteristic of the one according to the first embodiment of the present invention and a line M' indicates a characteristic of the one according to the fourth embodiment of the present invention.

Then, when the valve plate 21 pivots toward the fully open position O as shown in FIGS. 4 and 5, the warpage of the valve spring 22 is slightly increased while the valve spring 22 is being slid on the spring receiving surface 25*a* toward a valve plate 21 side. This slightly increases the repulsive force F of the valve spring 22 against the spring receiving surface 25*a*. However, since the direction of the repulsive force F approaches a state parallel to the outer surface of the flattened pipe portion 11*a* at the same time, the valve-closing force Fa is significantly decreased. As a result, such a characteristic as represented by a line M in FIG. 13 is exhibited that the torque of the valve-closing force Fa for closing the valve plate 21 decreases as the opening degree of the valve plate 21 increases. This means that when the valve plate 21 starts opening by the pressure in the rear-side silencing chamber 8, the valve plate 21 can pivot automatically at once to the fully open position O. Thereby, reduction in the back pressure and reduction in the gas flow sound can be surely achieved.

In addition, since the valve plate 21 is pivotably connected to the inner wall of the flattened pipe portion 11*a* through the flexible hinge member 23, the opening and closing operations of the valve plate 21 can be performed smoothly with few losses in the spring force of the valve spring 22.

Further, the rod-shaped spring receiving member 25 can be put into such a state that the cylindrical spring receiving surface 25*a* thereof is raised higher than the outer surface of the flattened pipe portion 11*a* simply by fastening the spring receiving member 25 to the outer surface of the flattened pipe portion 11*a*. Hence, when the valve spring 22 having the one end fastened to the tip end portion of the valve plate 21 is brought into pressure contact with the spring receiving surface 25*a*, the valve spring 22 is warped to thus generate the repulsive force.

Next, a second embodiment of the present invention shown in FIGS. 6 to 9 will be described.

In the second embodiment, a hook-shaped hinge portion 21*a* is formed at the base end portion of the valve plate 21. The hinge portion 21*a* pivotably engages with a long hinge hole 27*a* of a support member 27 that is welded to the inner wall of the flattened pipe portion 11*a*. In addition, the spring receiving member 25 is formed as a partition wall 25 that results from punching of the short-cut hole 17 and remains on the flattened pipe portion 11*a* so as to partition the short-cut hole 17 into two. In a central portion of the partition wall 25, a raised portion 25*b* is formed which is raised higher than the outer surface of the downstream exhaust pipe 11. The valve spring 22 is in pressure contact with the raised portion 25*b* in a slidable manner.

The other constitutions are the same as those in the aforementioned embodiment. Portions corresponding to those in the above embodiment are denoted by the same reference numerals in FIGS. 6 to 9, and overlapping descriptions are omitted.

According to the second embodiment, besides achieving the same operational effects as those in the first embodiment, the hinge connection structure of the valve plate 21 to the flattened pipe portion 11*a* can be obtained at low costs. Moreover, it is not necessary to use a dedicated member as the spring receiving member 25. This can contribute to the simplification of the structure, consequently to cost reduction.

Figure 10:
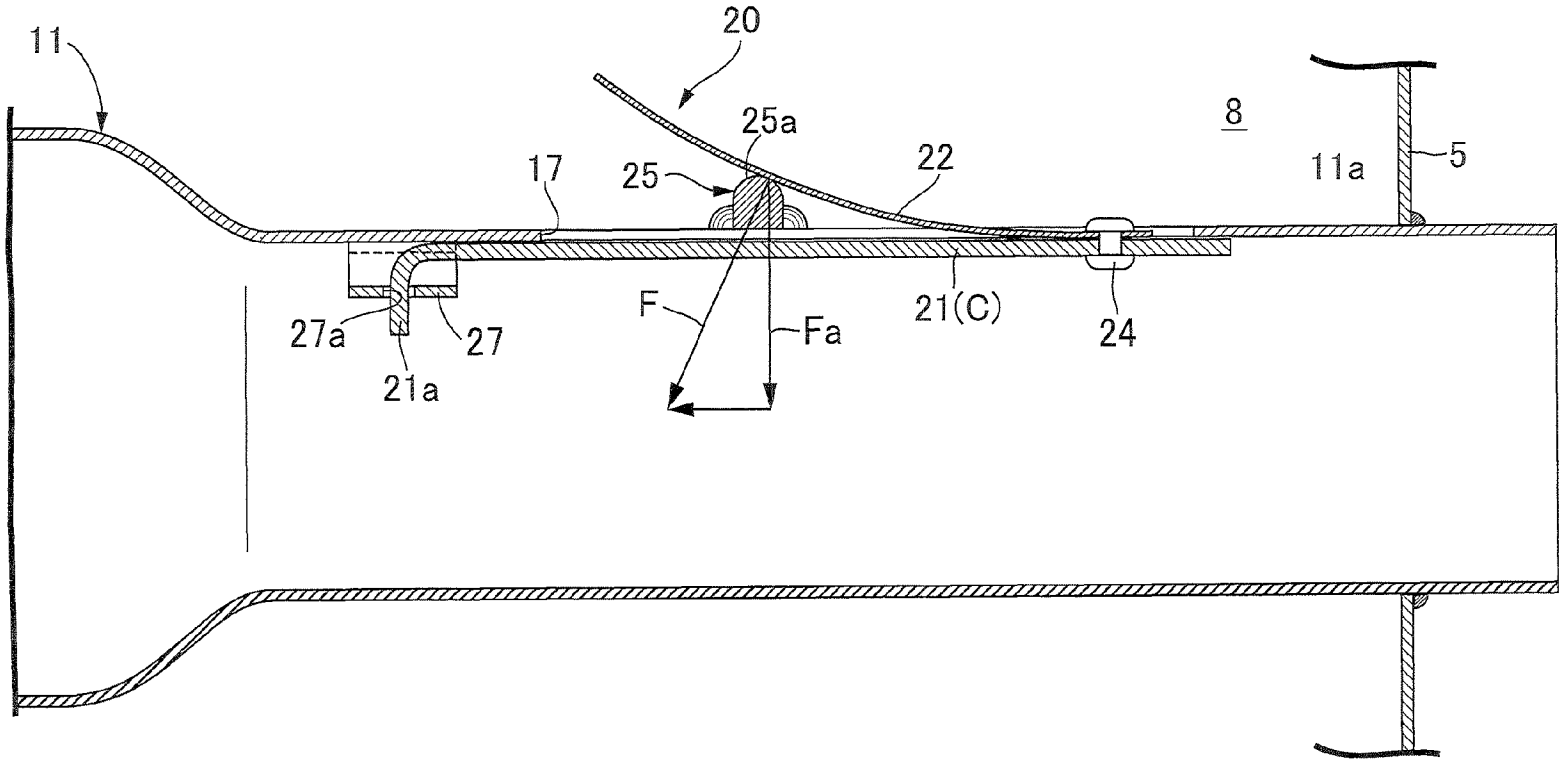
FIG. 10 is a view corresponding to FIG. 2 and showing a third embodiment of the present invention.

Next, a third embodiment of the present invention shown in FIG. 10 will be described.

In the third embodiment, as a hinge connection structure of the valve plate 21 to the flattened pipe portion 11*a*, the same structure as that in the second embodiment is employed. In addition, the spring receiving member 25 that is in the first embodiment is employed. In FIG. 10, portions corresponding to those in the first and second embodiments are denoted by the same reference numerals, and overlapping descriptions are omitted.

Figure 11:
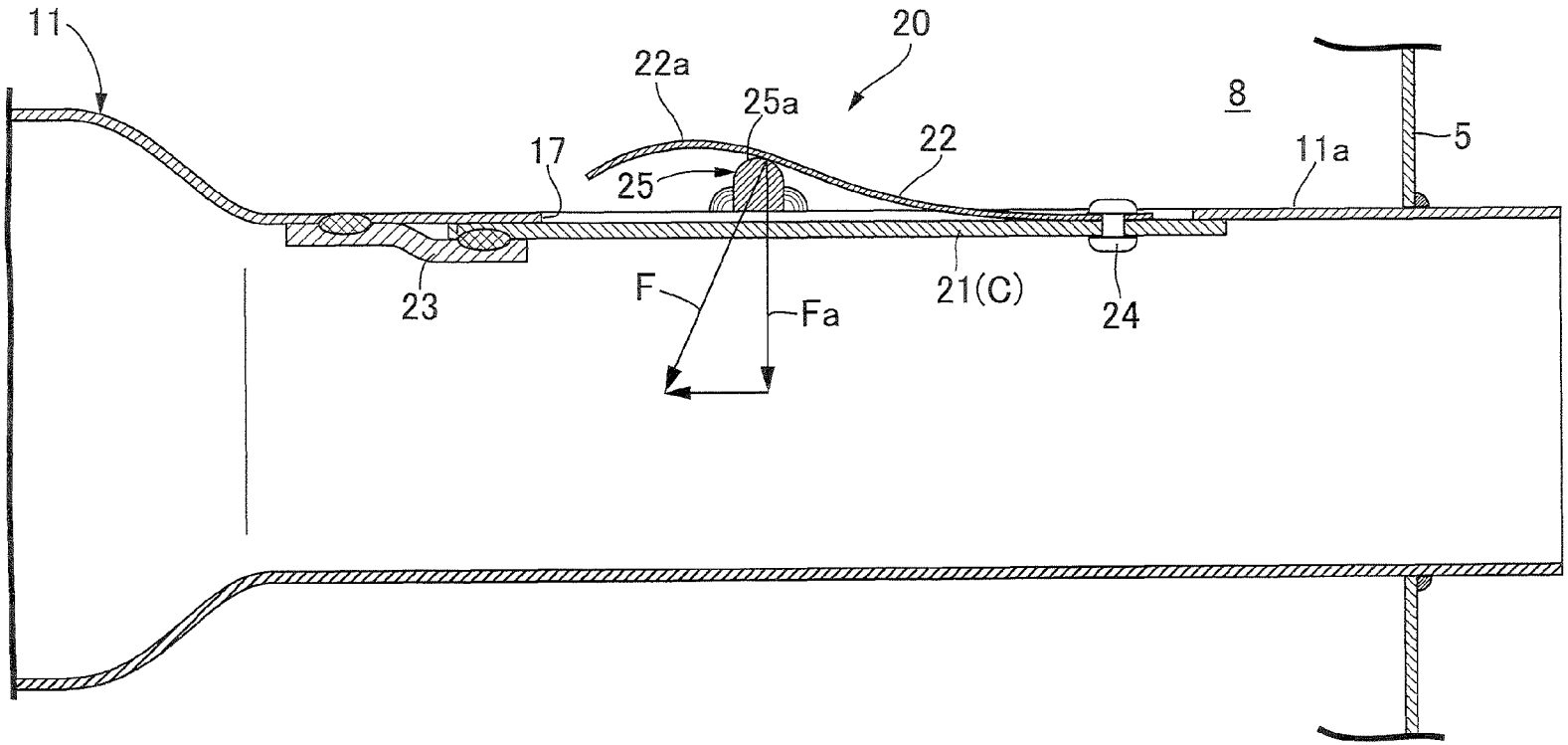
FIG. 11 is a view corresponding to FIG. 2 and showing a fourth embodiment of the present invention.
Figure 12:
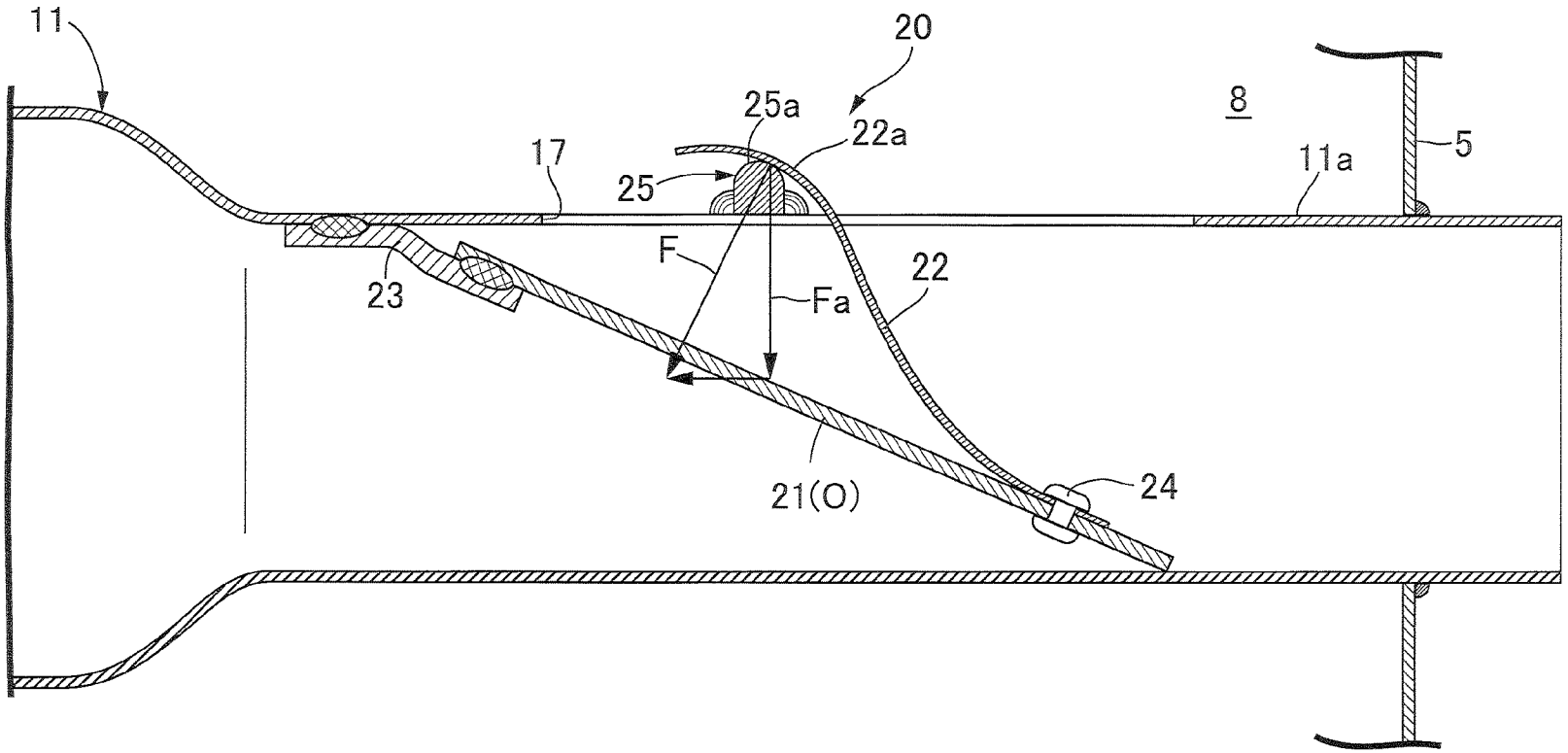
FIG. 12 is a view explaining an operation of the fourth embodiment.

Finally, a fourth embodiment of the present invention shown in FIGS. 11 and 12 will be described.

In the fourth embodiment, the tip end portion, which is located on the base end portion side of the valve plate 21 with respect to the spring receiving member 25, of the valve spring 22 is formed into a curved portion 22*a* that is curved toward the short-cut hole 17 when the valve plate 21 is at the fully closed position C. The other constitutions are the same as those in the first embodiment. In FIGS. 11 and 12, portions corresponding to those in the first embodiment are denoted by the same reference numerals, and overlapping descriptions are omitted.

According to the fourth embodiment, as the valve plate 21 approaches the fully open position O, the curved portion 22*a* of the valve spring 22 comes into pressure contact with the spring receiving surface 25*a*, and thereby the valve-closing force Fa of the valve spring 22 for the valve plate 21 can be made substantially constant (see a line M' in FIG. 13). This makes it possible to improve the returnability of the valve plate 21 to the fully closed position C for a case where the pressure in the rear-side silencing chamber 8 is decreased when the engine E returns to a low-speed, low-load operation state.

The present invention is not limited to the above embodiments, and may be modified in a variety of ways as long as the modifications do not depart from the gist of the present invention.

What is claimed is:

1. An exhaust flow control device for an exhaust muffler, comprising:

a short-cut hole provided in an intermediate portion in a longitudinal direction of a downstream exhaust pipe connected to a muffler body, the downstream exhaust pipe having one end portion communicating with an inside of the muffler body and having an opposite end portion opened to atmospheric air, the short-cut hole allowing communication between the inside of the muffler body and an inside of the intermediate portion of the downstream exhaust pipe; and an exhaust flow control valve appended to the downstream exhaust pipe and configured to close the short-cut hole when a pressure in the muffler body is lower than a predetermined value, and open the short-cut hole when the pressure is at the predetermined value or higher, wherein the exhaust flow control valve comprises:

a valve plate hinged to the downstream exhaust pipe in such a manner as to be pivotable, inside the downstream exhaust pipe, between a fully closed position where the short-cut hole is closed and a fully open position where the short-cut hole is opened, the valve plate having a tip end directed toward a downstream side of the downstream exhaust pipe when at the fully open position;

a spring receiving member provided to the downstream exhaust pipe in such a manner as to traverse the short-cut hole; and a valve spring having one end portion fastened to a tip end portion of the valve plate, the tip end portion being located on the downstream side of the downstream exhaust pipe with respect to the spring receiving member, and having an opposite end side being in pressure contact with the spring receiving member in a slidable manner, thereby generating a repulsive force to bias the valve plate toward the fully closed position.

2. The exhaust flow control device for an exhaust muffler according to claim 1, wherein a base end portion of the valve plate is connected to an inner wall of the downstream exhaust pipe through a flexible hinge member.

3. The exhaust flow control device for an exhaust muffler according to claim 1, wherein a hook-shaped hinge portion is formed at a base end portion of the valve plate, and the hinge portion pivotably engages with a hinge hole of a support member that is fastened to an inner wall of the downstream exhaust pipe.

4. The exhaust flow control device for an exhaust muffler according to claim 1, wherein opposite end portions of the rod-shaped spring receiving member are fastened to an outer surface of the downstream exhaust pipe, and the valve spring is in pressure contact with an outer peripheral surface of the spring receiving member in a slidable manner, the outer peripheral surface being raised higher than the outer surface of the downstream exhaust pipe.

5. The exhaust flow control device for an exhaust muffler according to claim 1, wherein the spring receiving member is formed as a partition wall that results from punching of the short-cut hole and remains on the downstream exhaust pipe so as to partition the short-cut hole into two, the partition wall has a raised portion formed therein which is raised higher than an outer surface of the downstream exhaust pipe, and the valve spring is in pressure contact with the raised portion in a slidable manner.

6. The exhaust flow control device for an exhaust muffler according to any one of claims 1, 4 and 5, wherein the tip end portion, located on a base end portion side of the valve plate with respect to the spring receiving member, of the valve spring is formed into a curved portion curved toward the short-cut hole when the valve plate is at the fully closed position.

* * * * *